US006099487A

United States Patent [19]

Chen

[11] Patent Number: 6,099,487

[45] Date of Patent: Aug. 8, 2000

[54] MASSAGE CHAIR DRIVE MECHANISM

[76] Inventor: Yuan-Chuen Chen, P.O. Box 453, Taichung, Taiwan

[21] Appl. No.: 09/158,621

[22] Filed: Sep. 22, 1998

[51] Int. Cl.[7] ..... A61H 7/00

[52] U.S. Cl. ..... 601/90; 601/93; 601/99; 601/102; 601/111; 310/75 R

[58] Field of Search ..... 601/23–25, 46, 601/49, 51–54, 56–58, 84, 86, 87, 89–94, 97–102, 111, 115, 116, 103; 310/75 R; D6/360, 367

[56] References Cited

U.S. PATENT DOCUMENTS

| | | | |
|---|---|---|---|
| 5,179,940 | 1/1993 | Barreiro | 601/99 |
| 5,460,598 | 10/1995 | Yamasaki et al. | 601/99 |
| 5,464,382 | 11/1995 | Wang | 601/99 |
| 5,792,080 | 8/1998 | Ookawa et al. | 601/115 |
| 5,877,570 | 3/1999 | Chen | 601/24 |

*Primary Examiner*—Richard J. Apley
*Assistant Examiner*—Justine R. Yu
*Attorney, Agent, or Firm*—Harrison & Egbert

[57] ABSTRACT

A massage chair drive mechanism having a main body, a kneading shaft rotatably mounted transversely to the main body and having a gear affixed thereto, a spiral gear engaging the gear of the kneading shaft and rotatably mounted within the main body and having a face gear connected thereto, a beating shaft rotatably mounted transversely to the main body and having a gear affixed thereto, a worm gear rotatably mounted within the main body and engaged with the gear of the beating shaft and having a face gear at one end thereof, a main shaft rotatably mounted within the spiral gear and the worm gear and having opposite ends extending outwardly of the main body, a clutch positioned between the face gears of the respective worm gear and spiral gear and first and second moving rods positioned within the main body and moveable so as to engage portions of the clutch. The clutch includes a first tubular member and a second tubular member with a compression spring connected thereto and extending therebetween. The first and second tubular members are slidably positioned over a multisided middle section of the main shaft. The tubular member have respective clutch gears engageable with the face gears of the spiral gear and the worm gear. Each of the clutch gears having a circumferential trough and an arc-shaped trough.

1 Claim, 3 Drawing Sheets

MASSAGE CHAIR DRIVE MECHANISM

FIELD OF THE INVENTION

The present invention relates generally to a massage chair, and more particularly to an improved massage chair drive mechanism.

BACKGROUND OF THE INVENTION

The conventional prior art massage chair drive mechanism 10, as shown in FIG. 5, is comprised of a main body 11, a kneading shaft 12, a spiral gear 14, a beating shaft 16, a worm gear 18, a main shaft 20 and a clutch 22.

The main body 11 is formed of two parts.

The kneading shaft 12 is rotatably mounted vertically and transverse of the main body 11. The kneading shaft 12 has a gear 13 which fits concentrically around the kneading shaft 12 and is fixedly connected to the kneading shaft 12. The gear 13 is rotatably mounted inside of and in the same plane as the main body 11. Gear 13 rotates in the horizontal plane of the main body 11. Both ends of the kneading shaft 12 extend outside the top and bottom parts of the main body 11.

The spiral gear 14 is rotatably mounted inside of and in a vertical transverse plane to the main body 11 and engages transversely with the gear 13 of the kneading shaft 12. The spiral gear 14 rotates in the vertical plane, which is transverse to the main body 11. The end of the spiral gear 14, which faces into the main body, has a face gear (not shown).

The beating shaft 16 is rotatably mounted vertically and transverse of the main body 11. The beating shaft 16 has a gear 17 which fits concentrically around and is fixedly connected to the beating shaft 16. The gear 17 is rotatably mounted inside of and in the same plane as the main body 11. Gear 17 rotates in the horizontal plane of the main body 11. Both ends of the beating shaft extend outside the top and bottom parts of the main body 11.

The worm gear 18 is rotatably mounted inside of and in a vertical transverse plane to the main body 11 and engages transversely with the gear 17 of the beating shaft 16. The worm gear 18 rotates in the vertical plane, which is transverse to the main body 11. The end of the worm gear 18, which faces into the main body has a face gear 19. The worm gear 18 is linearly aligned with the spiral gear 14 and on the same axis as spiral gear 14 within the main body 11.

The main shaft 20 is driven by the motor and rotatably mounted within the main body 11 so that the main shaft 20 extends through the linearly aligned spiral gear 14 and the worm gear 18. The main shaft 20 is rotatably mounted within spiral gear 14 and the worm gear 18 so that main shaft 20 can freely rotate without engaging either the spiral gear 14 or the worm gear 18. The plane of rotation for the main shaft 20 is the same rotation plane as both the spiral gear 14 and the worm gear 18. Both ends of the main shaft 20 extend outside the sides of the main body 11. The middle section 21 of the main shaft 20 fits between the spiral gear 14 and the worm gear 18 and has a larger diameter hexagonal-shaped tube body. The middle section 21 does not engage either the spiral gear 14 or the worm gear 18.

The clutch 22 is a tubular member with a hexagonal-shaped through hole 23 which fixedly engages the middle section 21 of the main shaft 20 so that rotation of the main shaft 20 and middle section 21 will cause the clutch 22 to similarly rotate. The clutch is located within the main body 11 between the spiral gear 14 and the worm gear 18. The opposite ends of the clutch 22 have end gears 24 which corresponding to the face gear of the spiral gear 14 and face gear 19 of the worm gear 18.

The end gears 24 of the clutch 22 have teeth to engage the face gears. When the teeth of the end gear 24 engage the teeth of the face gear associated with the spiral gear 14, the corresponding spiral gear 14 rotates and causes the kneading shaft 12 to knead. When the opposite end gear 24 engages the teeth of the face gear 19, the corresponding worm gear 18 rotates and causes the beating shaft 16 to beat. The shape of the teeth of the end gears 24 consist of a quarter-circular shape with a planar edge and a rounded arc edge. The shape of the teeth of the face gears consist of the same quarter-circular shape with a planar edge and a rounded arc edge. The end gear 24 engages the face gear with the planar edges of the teeth are aligned to allow the rotational thrust of the end gear 24 to be applied to the face gear and the corresponding spiral or worm gear. The teeth of the end gear 24 are aligned in opposite directions so that the teeth can only engage a single face gear at one time, depending on whether the main shaft 20 rotates forward or reverse. The clutch 22 works to engage either the spiral gear 14 or the worm gear 18 to achieve the functions of kneading or beating.

However, the prior art drive mechanism is defective. First, the kneading and beating functions cannot be operated at the same time. The clutch 22 makes only two selections for separate massage operations. Also, the changing between kneading and beating functions depends upon whether the main shaft 20 rotates forward or reverse, which diminishes the life of the motor. Furthermore, the burden of switching between forward and reverse decreases the durability of the clutch 22. Thus, the life of the massage drive mechanism 10 is shortened.

SUMMARY OF THE INVENTION

The primary objective of the present invention is therefore to provide a more durable and improved massage chair drive mechanism in which a clutch with two independent gears uses a compression spring to connect the main shaft to the spiral gear for kneading or the worm gear for beating or both. The present invention includes two moving rods which can protrude into two arc-shaped troughs on the opposite ends of the clutch, so as to guide the rods into corresponding fixed troughs on opposite sides of the clutch. As a moving rod is guided into a circumferential trough, a compression spring is compressed, which causes the clutch to shrink lengthwise so that the teeth of the end gear no longer engages the teeth of the face gear. Once a moving rod protrudes into a circumferential trough, an end of the compression spring is compressed so that the corresponding end gear of the clutch no longer engages the corresponding face gear, and corresponding massage function is stopped. Thus, the present invention allows the user to control the functions of kneading or beating or both, and the motor does not have to switch between forward and reverse rotations.

The foregoing objective and the features of the present invention will be readily understood upon a thoughtful deliberation of the following detailed description of a preferred embodiment of the present invention with reference to the accompanying drawing.

DETAILED DESCRIPTION OF THE EMBODIMENT

Figure 1:
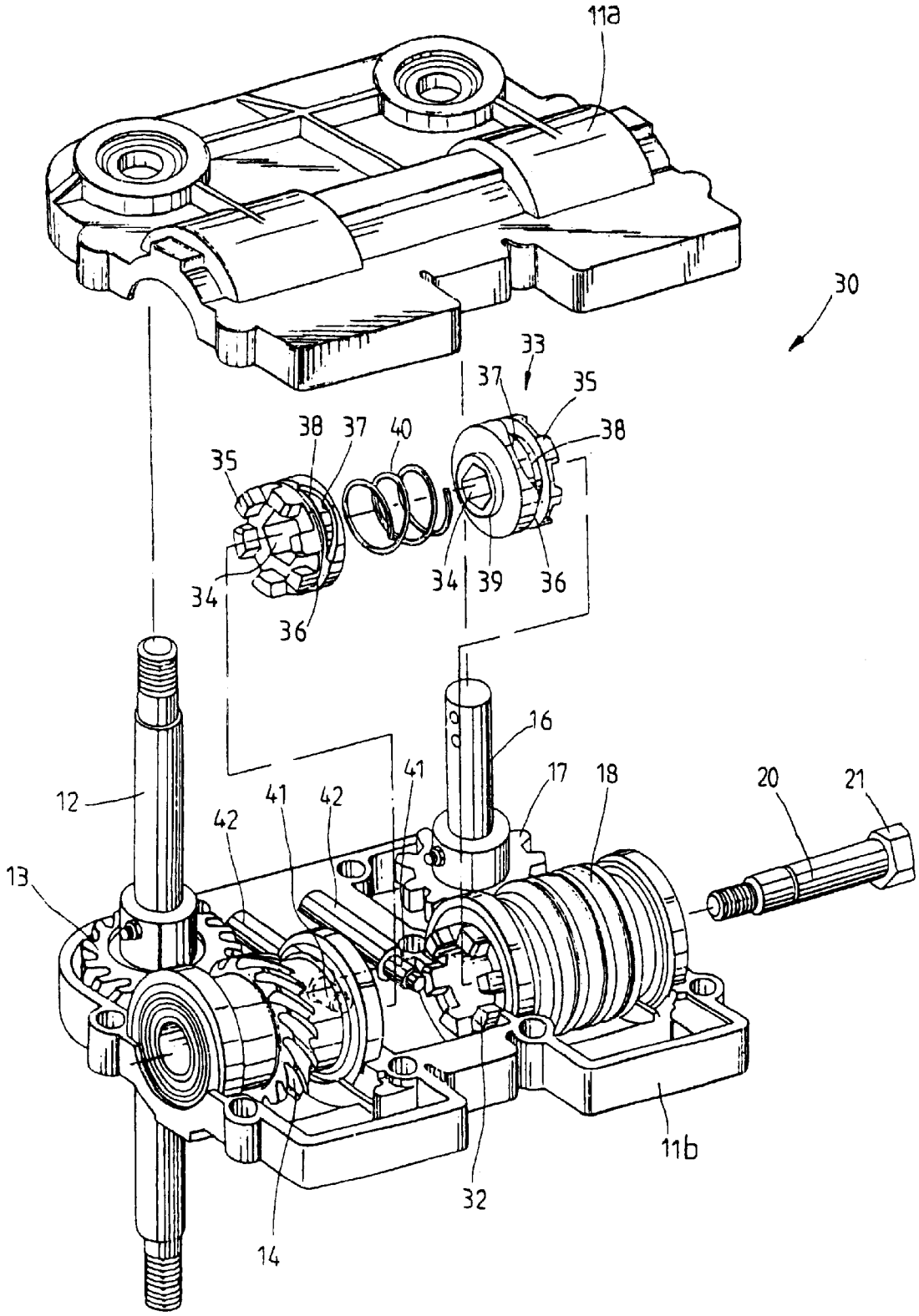
FIG. 1 shows a schematic view of the present invention.

As illustrated in FIG. 1, the present invention of an improved massage chair drive mechanism 30 includes a main body 11, a kneading shaft 12, a spiral gear 14, a beating shaft 16, a worm gear 18, a main shaft 20, a clutch 33, a compression spring 40, and two moving rods 41.

The main body 11 is comprised of a top part 11*a* and a bottom part 11*b*.

The kneading shaft 12 is rotatably mounted vertically and transverse of the main body 11. The kneading shaft 16 has a gear 13 which fits concentrically around and is fixedly connected to the kneading shaft 12. The gear 13 is rotatably mounted inside of and in the same plane as the main body 11. Gear 13 rotates in the horizontal plane of the main body 11. Both ends of the kneading shaft 12 extend outside the top part 11*a* and bottom part 11*b* of the main body 11.

The spiral gear 14 is rotatably mounted inside of and in a vertical transverse plane of the main body 11 and engages transversely with the gear 13 of the kneading shaft 12. The spiral gear 14 rotates in the vertical plane, which is transverse to the main body 11. The end of the spiral gear 14, which faces into the main body, has a face gear 31.

The beating shaft 16 is rotatably mounted vertically and transverse of the main body 11. The beating shaft 16 has a gear 17 which fits concentrically around and is fixedly connected to the beating shaft 16. The gear 17 is rotatably mounted inside of and in the same plane as the main body 11. Gear 17 rotates in the horizontal plane of the main body 11. Both ends of the beating shaft extend outside the top part 11*a* and bottom part 11*b* of the main body 11.

The worm gear 18 is rotatably mounted inside of and in a vertical transverse plane of the main body 11 and engages transversely with the gear 17 of the beating shaft 16. The worm gear 18 rotates in the vertical plane, which is transverse to the main body 11. The end of the worm gear 18, which faces into the main body, has a face gear 32. The worm gear 18 is linearly aligned with the spiral gear 14 and on the same axis as spiral gear 14 within the main body 11.

The main shaft 20 is driven by the motor and rotatably mounted within the main body 11 so that the main shaft 20 extends through the linearly aligned spiral gear 14 and the worm gear 18. The main shaft 20 is rotatably mounted within spiral gear 14 and the worm gear 18 so that main shaft 20 can freely rotate relative to the horizontal main body 11 without engaging either the spiral gear 14 or the worm gear 18. The plane of rotation for the main shaft 20 is the same rotation plane as both the spiral gear 14 and the worm gear 18. Both ends of the main shaft 20 extend outside the sides of the main body 11. The middle section 21 of the main shaft 20 fits between the spiral gear 14 and the worm gear 18 and has a larger diameter hexagonal-shaped body. The middle section 21 does not engage either the spiral gear 14 nor the worm gear 18.

The clutch 33 includes a compression spring 40 with two short tubular members 39 fastened at the ends of the compression spring 40. Tubular members 39 have hexagonal-shaped through holes 34 which fixedly engage the hexagonal middle section 21 of the main shaft 20 so that rotation of the main shaft 20 and middle section 21 causes the clutch 33 to similarly rotate. The main shaft 20 and middle section 21 extend through the center of the compression spring 40. The tubular members 39 can slide horizontally along the middle section 21, depending upon whether the compression spring 40 is compressed or not. The clutch 33 is located within the main body 11 between the spiral gear 14 and the worm gear 18. Tubular members 39 of the clutch 33 have end gears 35 which correspond to engage either face gear 31 of the spiral gear 14 or face gear 32 of the worm gear 18.

Both tubular members 39 of clutch 33 have similar configurations, including circumferential troughs 36 and arc-shaped troughs 37 around the outer surface. The end gear 35 is on the end of the tubular member, followed by the circumferential trough 36 and the arc-shaped trough 37. The arc-shaped trough 37 has a larger circumference than the circumferential trough 36 so that the moving rods 41 contact the outer tubular surface of the arc-shaped trough 37. The arc-shaped ridge on the tubular surface of the arc-shaped trough 37 guides the moving rod into the circumferential trough 36. Circumferential trough 36 has a smaller circumference than the arc-shaped trough 37 and contacts the arc-shaped trough 37 at edge 38 so that the moving rod 41 can fully extending its length once aligned in the circumferential trough 36.

The two moving rods 41 are horizontally mounted parallel to each other within shafts 42 in the main body 11 between the spiral gear 14 and the worm gear 18. The moving rods 41 are spaced so that the tips of the rods 41 contact the tubular members of the clutch 33 at the arc-shaped troughs 37. The moving rods 41 can extend to protrude inside the arc-shaped trough 37 and the circumferential trough 36. The extension of the rods 41 to protrude can be controlled by a conventional electromagnetic mechanism (not shown). As the arc-shaped trough on an end of the clutch 33 guides the extending moving rod 41 over the edge 38 and into corresponding circumferential trough 36, the compression spring 40 is compressed. The compression causes the clutch 33 to shrink lengthwise in size on that one end so that the teeth of the end gear 35 on that side of the clutch 33 no longer engages the corresponding teeth of the face gears 31 or 32. Once a moving rod 41 protrudes into a circumferential trough 36, an end of the compression spring 40 is compressed so that the corresponding end gear 35 of the clutch 33 no longer engages the corresponding face gear 31 or 32, and the corresponding spiral gear 14 or worm gear 18 no longer rotates to produce corresponding massage function.

The massage drive mechanism 30 functions so that the moving rods 41 control the setting of the clutch 33 to engage the spiral gear 14 and/or the worm gear 18. Unlike the prior art, the drive mechanism 30 can knead or beat or both without changing the forward or reverse rotation of the motor. The present invention achieves smoother transitions between kneading and/or beating functions.

Figure 2:
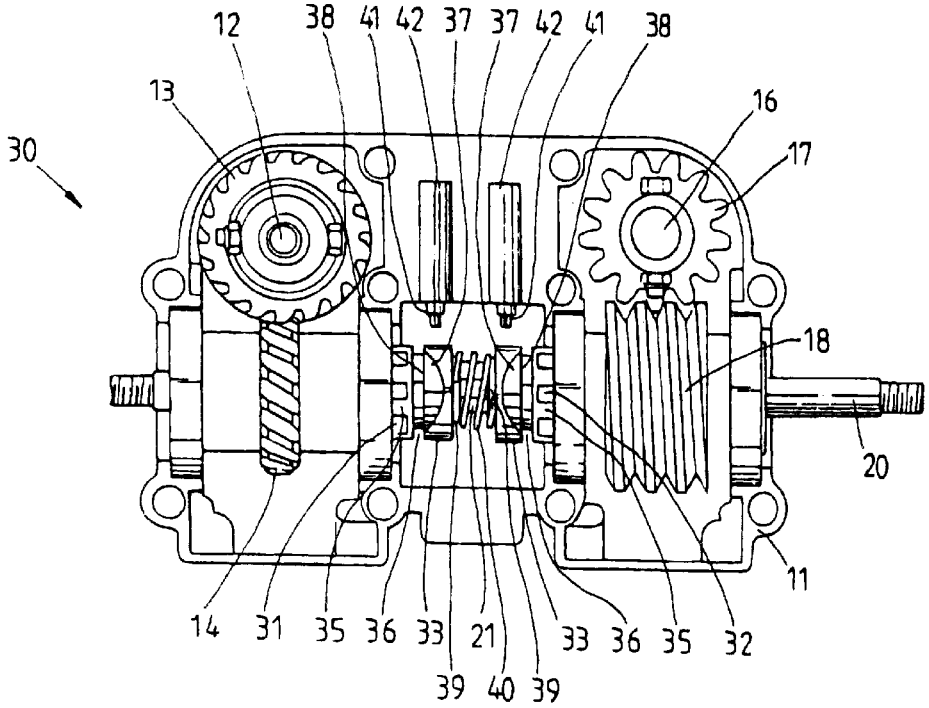
FIG. 2 shows a cross-sectional view of the present invention in a setting option for both kneading and beating.
Figure 3:
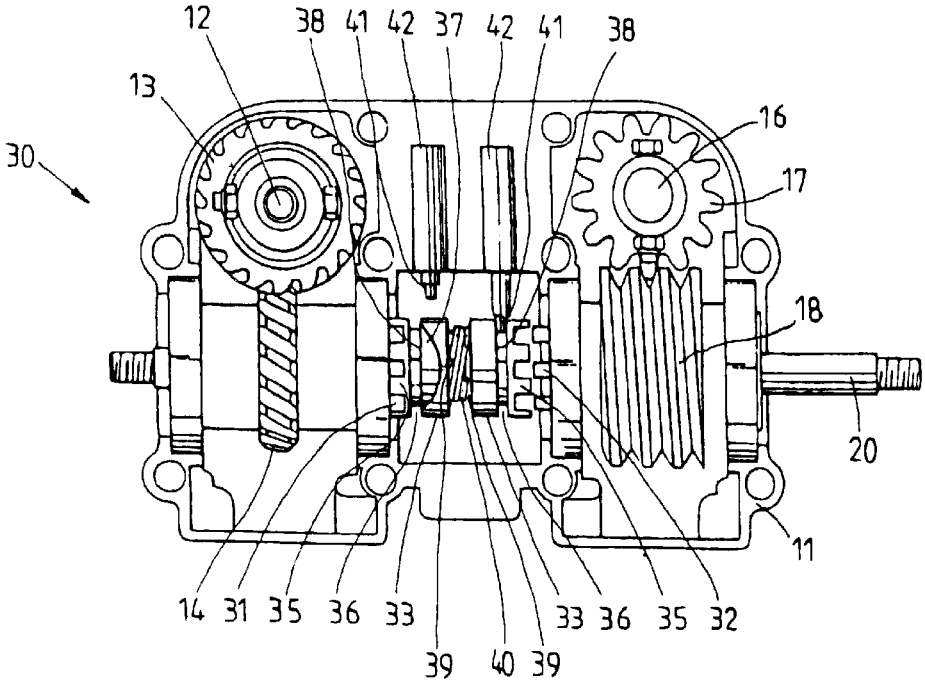
FIG. 3 shows a cross-sectional view of the present invention in a setting option for kneading only.
Figure 4:
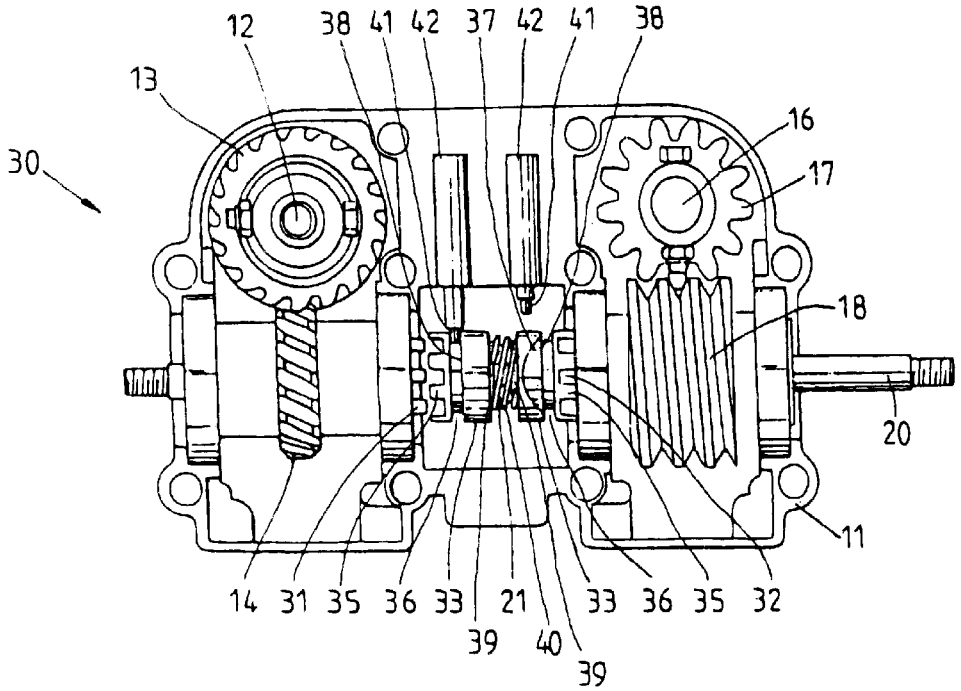
FIG. 4 shows a cross-sectional view of the present invention in a setting option for beating only.
Figure 5:
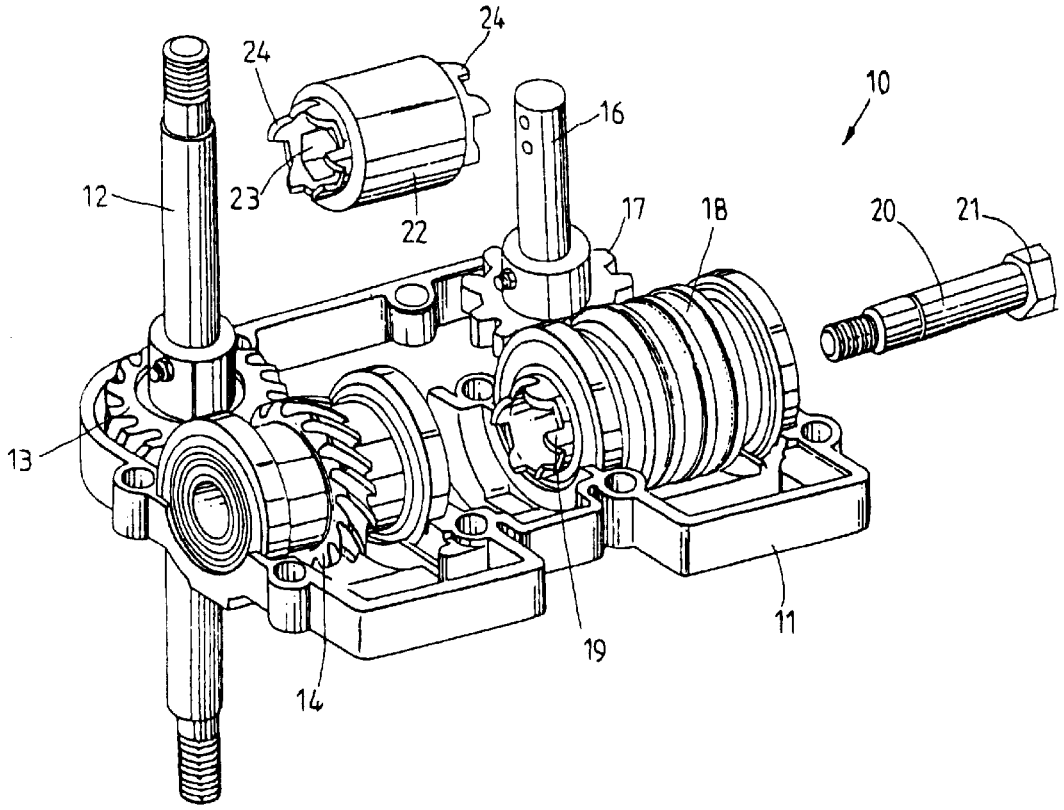
FIG.5 PRIOR ART
FIG. 5 shows a schematic view of the prior art.

The feature of the present invention is that the clutch 33 engages the middle section 21 of the main shaft 20, and the compression spring 40 is fastened to the tubular member ends 39 of the clutch 33. The clutch 33 functions so that the end gear 35 of the clutch 33 is engaged with the face gear 31 of the spiral gear 14 or the face gear 32 of the worm gear 18 to provide the functions of kneading and beating, as shown in FIG. 2. Moreover, the motor may turn the main shaft 20 forward or reverse and the motor can still provide the dual functions of kneading and beating. The clutch 33 now controls the independent driving of the spiral gear 14 or the worm gear 18, as shown in FIG. 3, kneading only, and FIG. 4, beating only.

When the moving rod 41 retracts from the circumferential trough 36 of the clutch 33, the end gear 35 of the clutch 33 is pushed by the compression spring 40 to expand back to engage the corresponding face gear 31 of the spiral gear 14 or the face gear 32 of the worm gear 18. The motor no longer switches directions to change massage functions, which preserves and increases the durability and life of the motor and clutch 33.

The embodiment of the present invention described above is to be deemed in all respects as being illustrative and not restrictive. Accordingly, the present invention may be embodied in other specific forms without deviating from the spirit thereof The present invention is therefore to be limited only by the scope of the following appended claim.

What is claimed is:

1. A massage chair drive mechanism comprising:

a main body having a top part and a bottom part;

a kneading shaft rotatably mounted transversely to said main body, said kneading shaft having opposite ends extending outwardly respectively of said top part and said bottom part of said main body, said kneading shaft having a gear affixed thereto, said gear of said kneading shaft positioned within said main body;

a spiral gear engaging said gear of said kneading shaft, said spiral gear being rotatably mounted in a plane transverse to said main body within said main body, said spiral gear having a face gear connected thereto;

a beating shaft rotatably mounted transversely to said main body, said beating shaft having opposite ends extending outwardly respectively of said main body, said beating shaft having a gear affixed thereto;

a worm gear rotatably mounted within said main body, said worm gear engaged with said gear of said beating shaft, said worm gear having a face gear at one end thereof, said face gear of said worm gear facing said face gear of said spiral gear;

a main shaft rotatably mounted within said spiral gear and said worm gear, said main shaft having opposite ends extending outwardly of said main body, said main shaft having a middle section positioned between said spiral gear and said worm gear, said middle section being multisided;

a clutch comprised of a first tubular member and a second tubular member with a compression spring extending therebetween, said first and second tubular members slidably positioned over said middle section of said main shaft between said spiral gear and said worm gear within said main body, said first tubular member having a clutch gear engageable with said face gear of said spiral gear, said second tubular member having a clutch gear engageable with said face gear of said worm gear, each of said clutch gears having a circumferential trough and arc-shaped troughs, said arc-shaped troughs having a depth less than a depth of said circumferential trough, said compression springs elastically engaging said first and second tubular members;

a first moving rod and a second moving rod positioned within said main body, said first and second moving rods being actuatable so as to move inwardly and outwardly, said first and second moving rods being respectively engaged with said arc-shaped troughs of said first and second tubular members when moved inwardly.

* * * * *